US012527378B2

(12) United States Patent
Dobson et al.

(10) Patent No.: US 12,527,378 B2
(45) Date of Patent: Jan. 20, 2026

(54) INTEGRATED FOOTWEAR COMPONENTS AND FOOTWEAR COMPRISING THE SAME

(71) Applicant: adidas AG, Herzogenaurach (DE)

(72) Inventors: Stephen P. Dobson, Portland, OR (US); Christian Manuel Arias Delgado, Portland, OR (US); Niccolo Dambrosio, Portland, OR (US); Theodore James Cotton, Milwaukie, OR (US); Keith A. Blume, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/680,738

(22) Filed: May 31, 2024

(65) Prior Publication Data

US 2025/0366562 A1 Dec. 4, 2025

(51) Int. Cl.
*A43B 13/02* (2022.01)
*A43B 23/02* (2006.01)

(52) U.S. Cl.
CPC ..... *A43B 13/02* (2013.01); *A43B 23/02* (2013.01)

(58) Field of Classification Search
CPC ..... A43B 1/0009; A43B 13/181; A43B 13/36; A43B 3/24; A43B 3/244; A43B 3/248; A43B 9/00; A43B 9/04; A43B 15/00; A43B 23/0245
See application file for complete search history.

(56) References Cited

U.S. PATENT DOCUMENTS 354,693 A 12/1886 Dick
1,111,437 A 9/1914 Butterfield
1,888,862 A * 11/1932 Mathews ..... A43B 3/10 D2/977
2,205,356 A 6/1940 Rose et al.
2,407,556 A * 9/1946 Kleven ..... A43B 3/10 36/12
2,417,776 A * 3/1947 Neunuebel ..... A43B 3/10 36/12

(Continued)

FOREIGN PATENT DOCUMENTS

CN 101611953 A 12/2009
CN 102578760 A 7/2012

(Continued)

OTHER PUBLICATIONS

"Adidas Breaks the Mould With 3D-Printed Performance Footwear," Adidas Group, [Retrieved on Oct. 7, 2015], Retrieved from the Internet: ( http://www.adidas-group.com/en/media/news-archive/press-releases/2015/adi-das-breaks-mould-3d-printed-performance-footwear/ ).

(Continued)

*Primary Examiner* — Ted Kavanaugh
(74) *Attorney, Agent, or Firm* — Sterne, Kessler, Goldstein & Fox P.L.L.C.

(57) ABSTRACT

Articles of footwear comprising movable components integrally formed with other parts of the footwear. The article of footwear can comprise a component integrally formed with an upper portion, a sole portion, or both, and connected to the upper portion or the sole portion at a hinged end. The component can comprise a second end opposite the hinged end that is attached to the upper portion or the sole portion at one or more connection points.

14 Claims, 10 Drawing Sheets

(56) References Cited

U.S. PATENT DOCUMENTS 2,434,024 A * 1/1948 Vlasak ..... A43B 13/32 36/3 R
2,538,170 A * 1/1951 Stritter ..... A43B 13/28 36/19 R
2,853,809 A 9/1958 Carlo
3,253,601 A 5/1966 Scholl
3,416,174 A 12/1968 Novitske
3,775,873 A * 12/1973 Small ..... A43B 3/106 36/11.5
3,793,750 A 2/1974 Bowerman
4,012,855 A 3/1977 Gardner
4,271,606 A 6/1981 Rudy
4,279,049 A 7/1981 Coiquaud
4,297,796 A 11/1981 Stirtz et al.
4,309,831 A 1/1982 Pritt
4,378,643 A 4/1983 Johnson
D272,963 S 3/1984 Muller et al.
4,439,936 A 4/1984 Clarke et al.
4,607,440 A 8/1986 Roberts et al.
4,638,577 A 1/1987 Riggs
4,694,831 A * 9/1987 Seltzer ..... A43B 7/146 601/134
4,774,774 A 10/1988 Allen, Jr.
5,224,279 A 7/1993 Agnew
5,236,637 A 8/1993 Hull
5,337,492 A 8/1994 Anderie et al.
5,367,791 A 11/1994 Gross et al.
5,391,072 A 2/1995 Lawton et al.
5,423,135 A 6/1995 Poole et al.
5,438,767 A 8/1995 Stein
5,529,473 A 6/1996 Lawton et al.
5,713,140 A 2/1998 Baggenstoss
5,799,417 A 9/1998 Burke et al.
5,862,614 A 1/1999 Koh
5,930,916 A 8/1999 Connor
5,983,529 A 11/1999 Serna
5,985,383 A 11/1999 Allen et al.
6,014,821 A 1/2000 Yaw
6,021,588 A 2/2000 Alviso
6,076,283 A 6/2000 Boie
6,259,962 B1 7/2001 Gothait
6,367,172 B2 4/2002 Hernandez
6,665,958 B2 12/2003 Goodwin
6,763,611 B1 7/2004 Fusco
7,234,248 B2 * 6/2007 Kelley ..... A43B 3/122 12/146 BC
7,383,647 B2 6/2008 Chan et al.
7,438,846 B2 10/2008 John
7,676,955 B2 3/2010 Dojan et al.
7,704,430 B2 4/2010 Johnson et al.
7,892,474 B2 2/2011 Shkolnik et al.
8,110,135 B2 2/2012 El-Siblani
8,191,284 B2 6/2012 Cho
8,522,454 B2 9/2013 Schindler et al.
8,739,639 B2 6/2014 Owings et al.
8,776,396 B2 7/2014 Huynh
8,914,998 B2 12/2014 Gheorghian et al.
8,978,272 B2 3/2015 Hurd et al.
9,205,601 B2 12/2015 DeSimone et al.
9,211,678 B2 12/2015 DeSimone et al.
9,216,546 B2 12/2015 DeSimone et al.
9,320,316 B2 4/2016 Guyan et al.
9,453,142 B2 9/2016 Rolland et al.
9,480,298 B2 11/2016 Barnes et al.
D789,060 S 6/2017 Guyan et al.
D809,752 S 2/2018 Campbell
9,883,713 B2 * 2/2018 Kawakami ..... A43B 3/24
9,930,929 B2 4/2018 Cooper et al.
10,010,133 B2 7/2018 Guyan
10,010,134 B2 7/2018 Guyan
10,016,013 B2 7/2018 Kormann et al.
10,034,516 B2 7/2018 Gheorghian et al.
10,039,343 B2 8/2018 Guyan
D829,425 S 10/2018 Albrecht et al.
D831,315 S 10/2018 Mahoney
10,104,934 B2 10/2018 Guyan
D841,300 S 2/2019 Albrecht et al.
D841,301 S 2/2019 Albrecht et al.
10,231,511 B2 3/2019 Guyan et al.
10,259,171 B2 4/2019 Robeson et al.
D847,481 S 5/2019 Albrecht et al.
D857,362 S 8/2019 Thompson
D859,801 S 9/2019 Jenkins et al.
D862,051 S 10/2019 Goussev et al.
D862,866 S 10/2019 Albrecht et al.
10,426,226 B2 10/2019 Guyan et al.
10,434,706 B2 10/2019 Robeson et al.
D873,546 S 1/2020 Henrichot
D876,056 S 2/2020 Henrichot
D878,016 S 3/2020 Henrichot
D879,428 S 3/2020 Braun et al.
D879,434 S 3/2020 Fick et al.
10,575,588 B2 3/2020 Perrault et al.
D880,120 S 4/2020 Fick et al.
D880,122 S 4/2020 Fick et al.
D880,131 S 4/2020 Fick et al.
D882,227 S 4/2020 Braun et al.
10,639,861 B2 5/2020 Minh et al.
D890,485 S 7/2020 Perrault et al.
D907,904 S 1/2021 Perrault et al.
11,160,326 B2 * 11/2021 Bramani ..... A43B 3/244
2002/0078598 A1 6/2002 Bell
2004/0087230 A1 5/2004 Wildeman
2006/0201028 A1 9/2006 Chan et al.
2006/0254087 A1 11/2006 Fechter
2007/0011914 A1 1/2007 Keen et al.
2007/0043582 A1 2/2007 Peveto et al.
2008/0289218 A1 11/2008 Nakano
2009/0013556 A1 1/2009 Nishiwaki et al.
2009/0126225 A1 5/2009 Jarvis
2009/0139112 A1 6/2009 Garneau
2009/0183392 A1 7/2009 Shane
2009/0211114 A1 8/2009 Ivester et al.
2009/0293309 A1 12/2009 Keating et al.
2010/0122471 A1 5/2010 Edington et al.
2010/0170106 A1 7/2010 Brewer et al.
2010/0199520 A1 8/2010 Dua et al.
2010/0251565 A1 10/2010 Litchfield et al.
2010/0281714 A1 11/2010 Carboy et al.
2011/0099855 A1 5/2011 Cho
2012/0117825 A9 5/2012 Jarvis
2012/0167416 A1 7/2012 Christensen et al.
2012/0178259 A1 7/2012 Miyazaki et al.
2012/0180335 A1 7/2012 Mahoney
2012/0186107 A1 7/2012 Crary et al.
2013/0118036 A1 5/2013 Gibson
2013/0145653 A1 6/2013 Bradford
2013/0171019 A1 7/2013 Gessler et al.
2013/0292862 A1 11/2013 Joyce
2013/0295212 A1 11/2013 Chen et al.
2014/0020191 A1 1/2014 Jones et al.
2014/0026773 A1 1/2014 Miller
2014/0029030 A1 1/2014 Miller
2014/0109441 A1 4/2014 McDowell et al.
2014/0150297 A1 6/2014 Holmes et al.
2014/0182170 A1 7/2014 Wawrousek et al.
2014/0223783 A1 8/2014 Wardlaw et al.
2014/0226773 A1 8/2014 Toth et al.
2014/0259779 A1 9/2014 Hashish et al.
2014/0259787 A1 9/2014 Guyan et al.
2014/0259788 A1 9/2014 Dojan et al.
2014/0259789 A1 9/2014 Dojan et al.
2014/0299009 A1 10/2014 Miller et al.
2014/0300675 A1 10/2014 Miller et al.
2014/0300676 A1 10/2014 Miller et al.
2014/0310991 A1 10/2014 Greene et al.
2015/0000161 A1 1/2015 Peyton et al.
2015/0033577 A1 2/2015 Dahl et al.
2015/0033579 A1 2/2015 Barnes et al.
2015/0033581 A1 2/2015 Barnes et al.
2015/0089841 A1 4/2015 Smaldone et al.
2015/0128448 A1 5/2015 Lockyer
2015/0181976 A1 7/2015 Cooper et al.

(56) References Cited

U.S. PATENT DOCUMENTS

| | | | | |
|---|---|---|---|---|
| 2015/0223560 | A1 | 8/2015 | Wawrousek et al. | |
| 2015/0245686 | A1 | 9/2015 | Cross | |
| 2015/0331402 | A1 | 11/2015 | Lin et al. | |
| 2015/0351493 | A1 | 12/2015 | Ashcroft et al. | |
| 2015/0360419 | A1 | 12/2015 | Willis et al. | |
| 2016/0051009 | A1 | 2/2016 | Kormann et al. | |
| 2016/0122493 | A1 | 5/2016 | Farris et al. | |
| 2016/0137839 | A1 | 5/2016 | Rolland et al. | |
| 2016/0160077 | A1 | 6/2016 | Rolland et al. | |
| 2016/0180440 | A1 | 6/2016 | Dibenedetto et al. | |
| 2016/0288376 | A1 | 10/2016 | Sun et al. | |
| 2016/0295971 | A1 | 10/2016 | Arnese et al. | |
| 2016/0324260 | A1 | 11/2016 | Guyan | |
| 2016/0324261 | A1 | 11/2016 | Guyan | |
| 2016/0360828 | A1 | 12/2016 | Guyan | |
| 2016/0374428 | A1 | 12/2016 | Kormann et al. | |
| 2017/0129167 | A1 | 5/2017 | Castanon | |
| 2017/0129169 | A1 | 5/2017 | Batchelder et al. | |
| 2017/0150778 | A1 | 6/2017 | Youngs et al. | |
| 2018/0014606 | A1 | 1/2018 | Mokos | |
| 2018/0070736 | A1 | 3/2018 | Achten et al. | |
| 2018/0103719 | A1 | 4/2018 | Chen | |
| 2018/0126630 | A1 | 5/2018 | Panzer et al. | |
| 2018/0243976 | A1 | 8/2018 | Feller | |
| 2018/0271211 | A1 | 9/2018 | Perrault et al. | |
| 2018/0271213 | A1 | 9/2018 | Perrault et al. | |
| 2018/0290374 | A1 | 10/2018 | Willis et al. | |
| 2018/0368518 | A1 | 12/2018 | Re et al. | |
| 2019/0069632 | A1 | 3/2019 | Meschter | |
| 2019/0098960 | A1 | 4/2019 | Weisskopf et al. | |
| 2019/0160733 | A1 | 5/2019 | Mirkin et al. | |
| 2019/0223543 | A1 | 7/2019 | Tamm et al. | |
| 2019/0223551 | A1 | 7/2019 | Hoffer et al. | |
| 2019/0269200 | A1 | 9/2019 | Tseng | |
| 2019/0289960 | A1 | 9/2019 | Loveder | |
| 2020/0093221 | A1 | 3/2020 | Caldwell et al. | |
| 2020/0156308 | A1 | 5/2020 | Ramos et al. | |
| 2020/0329815 | A1 | 10/2020 | Schmid | |
| 2021/0195989 | A1 | 7/2021 | Iwasa et al. | |
| 2021/0195995 | A1 | 7/2021 | Sakamoto et al. | |
| 2022/0110406 | A1 | 4/2022 | Salari-Sharif et al. | |
| 2022/0110407 | A1 | 4/2022 | Hettinga et al. | |
| 2022/0110408 | A1 | 4/2022 | Coonrod et al. | |
| 2023/0337783 | A1* | 10/2023 | Hatano | A43B 3/106 |
| 2024/0032649 | A1 | 2/2024 | Corcoran-Tadd et al. | |
| 2024/0130465 | A1* | 4/2024 | Schnitman | A43B 13/36 |

FOREIGN PATENT DOCUMENTS

| | | | |
|---|---|---|---|
| CN | 203378623 | U | 1/2014 |
| CN | 209391169 | U | 9/2019 |
| CN | 209403686 | U | 9/2019 |
| CN | 110859355 | A | 3/2020 |
| EP | 0526892 | A2 | 2/1993 |
| EP | 2564719 | A1 | 3/2013 |
| EP | 2424398 | B1 | 12/2015 |
| EP | 3013171 | A1 | 5/2016 |
| EP | 3165109 | A1 | 5/2017 |
| EP | 2564714 | B1 | 7/2018 |
| EP | 3939462 | A2 | 1/2022 |
| ES | 2442448 | A1 | 2/2014 |
| ES | 2578730 | A1 | 7/2016 |
| FR | 1211739 | A | 3/1960 |
| GB | 2078490 | A | 1/1982 |
| JP | 3192899 | B2 | 7/2001 |
| JP | 2002238609 | A | 8/2002 |
| JP | 2011251190 | A | 12/2011 |
| JP | 2014151201 | A | 8/2014 |
| JP | 3192899 | U | 9/2014 |
| WO | WO-2010126708 | A2 | 11/2010 |
| WO | WO-2014008331 | A2 | 1/2014 |
| WO | WO-2014009587 | A1 | 1/2014 |
| WO | WO-2014015037 | A2 | 1/2014 |
| WO | WO-2014100462 | A1 | 6/2014 |
| WO | WO-2015164234 | A1 | 10/2015 |
| WO | WO-2015169941 | A1 | 11/2015 |
| WO | WO-2015169942 | A1 | 11/2015 |
| WO | WO-2016066750 | A1 | 5/2016 |
| WO | WO-2017210298 | A1 | 12/2017 |
| WO | WO-2021169804 | A1 | 9/2021 |

OTHER PUBLICATIONS

Green, D., Adidas is finally bringing 3D-printed shoes into the mainstream,Business Insider.com, Dennis Green, Retrieved from the Internet: (URL:https://www.businessinsider.com/adidas-releases-futurecraft-4d-shoe-2017-4/commerce-on-business-insider), (Year: 2017).

Janusziewicz, R., et al., "Layerless Fabrication With Continuous Liquid Interface Production," Proceedings of the National Academy of Sciences of the United States of America 113(42):11703-11708, National Academy of Sciences, United States (Oct. 2016).

Nikolic, I., Reebok Flexagon Training Shoes, Behance.net, Ilija Nikolic, Retrieved from the Internet (URL: https://www.behance.net/gallery/68953047/REEBOK-FLEXAGON-Training-Shoes?t-racking_source=curated_galleries_list) 2018, 10 pages.

Panetta., et al., "Elastic Textures for Additive Fabrication," ACM Transactions on Graphics 34(4), Article No. 135 (Aug. 2015).

Pearson, D., Adidas is giving Olympic athletes its first-ever 3D-printed shoes,Highsnobiety.com, Retrieved from the Internet: (URL:https://www.highsnobiety.com/2016/08/11/adidas-3d-printed-shoes-olympics/), (Year: 2016).

Reebok Flexagon, Retrieved from the Internet (URL: https://www.reebok.com/us/reebok-flexagon/CN2583.html), 2018.

Richard, B., Here's what 3D printed Future Craft adidas Yeezy boosts would look like Yeezys geared up for the future Retrieved from the Internet: (URL:https://solecollector.com/news/2015/11/adidas-yeezy-futurecraft-3d-print), (Year: 2015).

Tumbleston, J.R., et al., "Continuous Liquid Interface Production of 3d Objects," Science 347(6228):1349-1352, American Association for the Advancement of Science, United States (Mar. 2015).

Worman, C., Top Tennis Shoes Featuring a 6-Month Outsole Warranty, Retrieved from the Internet (URL: https://blogs.tennisexpress.com/blogs/top-tennis-shoes-featuring- -a-6-month-outsole-warranty/), (Year: 2018), 11 pages.

* cited by examiner

INTEGRATED FOOTWEAR COMPONENTS AND FOOTWEAR COMPRISING THE SAME

FIELD

The described embodiments generally relate to articles of footwear. More particularly, described embodiments relate to footwear parts formed as a single, integrated structure with one or more movable components.

BACKGROUND

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during everyday activity. Unless an individual is wearing shoes that provide proper cushioning and support, the soreness and fatigue associated with every day activity is more acute, and its onset may be accelerated.

Individuals are often concerned with the amount of cushion and support an article of footwear provides. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. Proper footwear should be durable, comfortable, and provide other beneficial characteristics for an individual. Optimizing footwear to meet these concerns can result in complex, multi-component structures. These structures can require increased manufacturing time, and in particular require multiple formation (e.g., molding or printing) steps followed by assembly steps.

Therefore, a continuing need exists for innovations in footwear. In particular cases, there is a need to create footwear that meets the above design requirements while also reducing manufacturing complexity and time.

BRIEF SUMMARY

Embodiments according to the present disclosure are directed to articles of footwear formed from a single or relatively few parts comprising integrated footwear components. The parts can comprise one or more integral movable components that can be moved from a first, manufactured position to a second position on the article of footwear. These parts can be assembled to form various portions of the article of footwear.

A first embodiment (I) of the present disclosure is directed to an article of footwear comprising an upper portion and a sole portion connected to the upper portion, the sole portion comprising a three-dimensional mesh comprising a plurality of interconnected unit cells, each interconnected unit cell comprising a plurality of unit cell struts defining a three-dimensional structure and a plurality of nodes at which one or more unit cell struts are connected. The article of footwear can also comprise a component integrally formed with the upper portion, the sole portion, or both and connected to the upper portion or the sole portion at a hinged end opposite a second end of the component that is attached to the upper portion or the sole portion at a connection point.

In a second embodiment (II), the hinged end of the first embodiment (I) is configured to allow the component to be moved from a first position where the second end of the component is spatially separated from the connection point on the upper portion or the sole portion to a second position where the second end of the component is attached to the upper portion or the sole portion at the connection point.

In a third embodiment (III), the component according to the first embodiment (I) or the second embodiment (II) is integrally formed with the sole portion, and the second end of the component is attached to a top surface of the sole portion.

In a fourth embodiment (IV), the component according to the third embodiment (III) is formed with a first connector that is connected to a second connector formed on a top surface of the sole portion, and the component is attached to a surface of the upper portion.

In a fifth embodiment (V), the article of footwear according to any one of embodiments (I)-(IV) comprises a plurality of the components, each component being separate from the other components, and each component being connected to the upper portion or the sole portion at a hinged end opposite a second end of the component that is attached to the upper portion or the sole portion at a connection point.

In a sixth embodiment (VI), the hinged end of each of the plurality of components according to the fifth embodiment (V) is configured to allow the component to be moved from a first position where the second end of the component is spatially separated from the respective connection point on the upper portion or the sole portion to a second position where the second end of the component is attached to the upper portion or the sole portion at the respective connection point.

In a seventh embodiment (VII), each of the plurality of components according to the fifth embodiment (V) or the sixth embodiment (VI) is formed with a first connector that is connected to a corresponding second connector formed on a top surface of the sole portion, and each of the plurality of components is attached to a surface of the upper portion.

In an eighth embodiment (VIII), the plurality of components according to any one of embodiments (V)-(VII) form all or a portion of a lace support, a cage, a flange, a heel counter, a strap, or a sleeve extending from the sole portion.

In an ninth embodiment (IX), the plurality of components according to any one of embodiments (V)-(VII) are integrally formed with the sole portion, the plurality of components form all or a portion of a shell, and a portion of the upper portion is received within the shell.

In a tenth embodiment (X), each of the components according to any one of embodiments (V)-(IX) further comprises a second connector connected to the corresponding second connector on another one of the plurality of components.

In an eleventh embodiment (XI), the component according to any one of embodiments (I)-(IV) forms all or a portion of a lace support, a cage, a flange, a heel counter, a strap, a sleeve, or a tongue.

In a twelfth embodiment (XII), the upper portion and the sole portion according to any one of embodiments (I)-(XI) are integrally formed as a single piece.

In a thirteenth embodiment (XIII), the article of footwear according to any one of embodiments (I)-(IV) further comprises a textile component disposed between the component and at least one of the sole portion or the upper portion.

In a fourteenth embodiment (XIV), the component according to any one of embodiments (I)-(IV) is a tongue.

A fifteenth embodiment (XV) of the present disclosure is directed to an article of footwear comprising an upper portion; a sole portion connected to the upper portion; and a component integrally formed with the upper portion, the sole portion, or both, and connected to the upper portion or the sole portion at a hinged end opposite a second end of the component that is attached to the upper portion or the sole portion at a connection point.

In a sixteenth embodiment (XVI), the hinged end according to the fifteenth embodiment (XV) is configured to allow the component to be moved from a first position where the second end of the component is spatially separated from the connection point on the upper portion or the sole portion to a second position where the second end of the component is attached to the upper portion or the sole portion at the connection point.

In a seventeenth embodiment (VXII), the component according to the fifteenth embodiment (XV) or the sixteenth embodiment (XVI) is formed with a first connector that is connected to a second connector that is formed on a top surface of the sole portion, and the component is attached to a surface of the upper portion.

In an eighteenth embodiment (VXIII), the article of footwear according to any one of embodiments (XV)-(XVII) further comprises a plurality of the components, each component integrally formed with the upper portion, the sole portion, or both, and connected to the upper portion or the sole portion at a hinged end opposite a second end of the component that is attached to the upper portion or the sole portion at a connection point.

In an nineteenth embodiment (XIX), each of the plurality of components according to the eighteenth embodiment (VXIII) is formed with a first connector that is connected to a corresponding second connector formed on a top surface of the sole portion, and each of the plurality of components is attached to a surface of the upper portion.

In a twentieth embodiment (XX), at least two components of the plurality of components according to the eighteenth embodiment (VXIII) or the nineteenth embodiment (XIX) are configured to engage each other.

In a twenty-first embodiment (XXI), the component according to any one of embodiments (XV)-(XVII) further comprises a connector connected to a corresponding connector formed with another component integrally formed with the upper portion, the sole portion, or both.

In a twenty-second embodiment (XXII), the component according to any one of embodiments (XV)-(XVII) forms all or a portion of a lace support, a cage, a flange, a heel counter, a sleeve, a strap, or a tongue.

In a twenty-third embodiment (XXIII), the article of footwear according to any one of embodiments (XV)-(XVII) further comprises a textile component disposed between the component and at least one of the sole portion or the upper portion.

In a twenty-fourth embodiment (XXIV), at least one of the sole portion or the upper portion according to any one of embodiments (XV)-(XXIII) is formed by an additive manufacturing process and comprises a three-dimensional mesh comprising a plurality of unit cells, each unit cell comprising a plurality of unit cell struts defining a three-dimensional structure and a plurality of nodes at which one or more unit cell struts are connected.

A twenty-fifth embodiment (XXV) of the present disclosure is directed to a method of manufacturing an article of footwear, the method comprising integrally forming a footwear part and a component connected to the footwear part at a hinged end of the component as a single piece in a first position, wherein the footwear part comprises an upper portion for the article of footwear or a sole portion for the article of footwear, and wherein the component comprises a second end that is not directly connected to the footwear part. The method further comprises moving the second end of the component relative to the footwear part and into a second position, and connecting the second end of the component to the footwear part at a connection point.

In a twenty-sixth embodiment (XXVI), moving the second end of the component relative to the footwear part according to the twenty-fifth embodiment (XXV) puts the second end into contact with the footwear part.

In a twenty-seventh embodiment (XXVII), the footwear part according to the twenty-fifth embodiment (XXV) or the twenty-sixth embodiment (XXVI) comprises the sole portion, and the movement of the component places the second end of the component in contact with a top surface of the sole portion.

In a twenty-eighth embodiment (XXVIII), the footwear part according to the twenty-fifth embodiment (XXV) or the twenty-sixth embodiment (XXVI) comprises the upper portion, and the movement of the component places the second end of the component in contact with the upper portion.

In a twenty-ninth embodiment (XXIX), moving the component according to any one of embodiments (XXV)-(XXVIII) comprises connecting a first connector integrally formed with the component to a corresponding second connector formed with the footwear part at the connection point.

In a thirtieth embodiment (XXX), the footwear part according to the twenty-fifth embodiment (XXV) or the twenty-sixth embodiment (XXVI) comprises the sole portion, and the method further comprises connecting the sole portion to the upper portion by connecting the upper portion to the component after moving the component.

In a thirty-first embodiment (XXXI), the method according to any one of embodiments (XXV)-(XXX) further comprises heating the component when in the second position to cure the component in the second position.

In a thirty-second embodiment (XXXII), the method according to any one of embodiments (XXV)-(XXXI) further comprises, before heating the component, applying a jig to the component when in the second position to shape the component in the second position.

In a thirty-third embodiment (XXXIII), moving the second end of the component relative to the footwear part according to any one of embodiments (XXV)-(XXXII) puts the second end into contact with the footwear part when the component and the footwear part are in a green state, and the method further comprises applying a curable resin that is formed from the same material as the footwear part to a contact point between the component and the footwear part in the green state.

In a thirty-fourth embodiment (XXXIV), the method according to the thirty-third embodiment (XXXIII) further comprises, after applying the curable resin, at least partially curing the curable resin; and heating the component, the footwear part, and the at least partially cured resin to secure the component to the footwear part.

In a thirty-fifth embodiment (XXXV), the method according to any one of embodiments (XXV)-(XXXIV) further comprises forming a second component integrally attached to the footwear part at a hinged end of the second component; and moving the second component relative to the footwear part to connect with the component.

In a thirty-sixth embodiment (XXXVI), the method according to any one of embodiments (XXV)-(XXXV)

further comprises integrally forming a support to hold the component in the first position; and removing the support when moving the component to the second position.

In a thirty-seventh embodiment (XXXVII), the method according to any one of embodiments (XXV)-(XXXVI) further comprises positioning a textile component between the component and the footwear part before moving the component.

DETAILED DESCRIPTION

Figure 1:
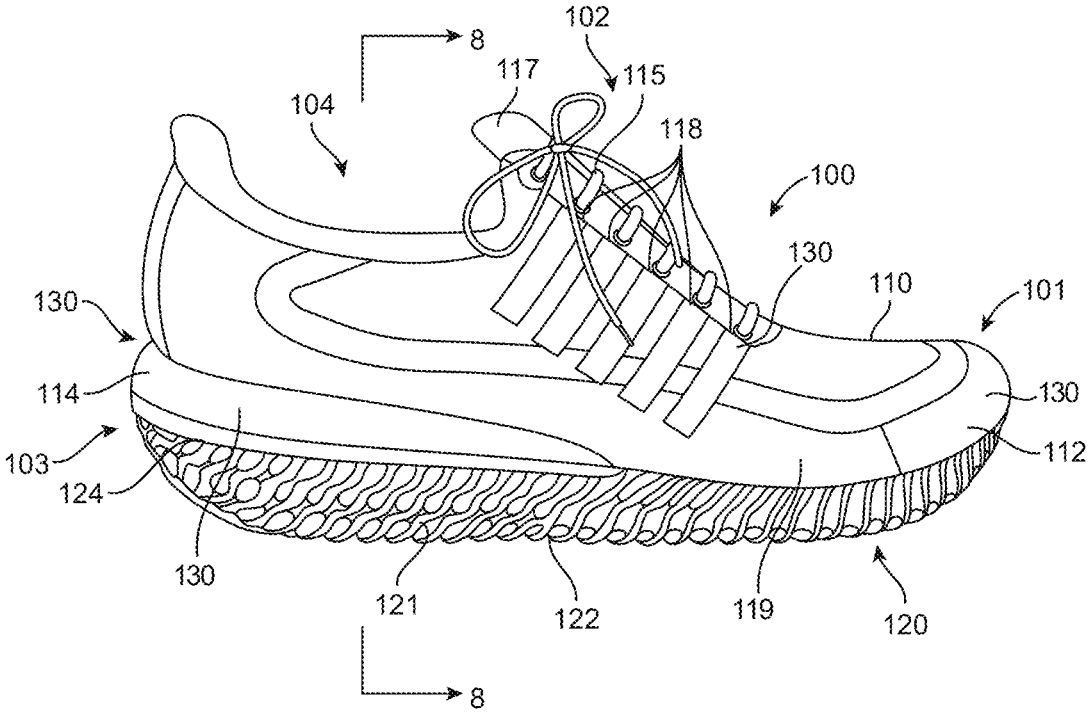
FIG. 1 shows an article of footwear according to some embodiments.

The present invention(s) will now be described in detail with reference to embodiments thereof as illustrated in the accompanying drawings. References to "some embodiments", "one embodiment", "an embodiment", "an exemplary embodiment", etc., indicate that the embodiment described can comprise a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

Articles of footwear with multiple design features can increase manufacturing time and complexity. This disclosure seeks to address this issue by providing articles of footwear comprising one or more parts formed in a single process as one integrated part. This part can include components that are partially separate from, but still joined to and integrated with the footwear part. These components can be moved relative to the footwear part, other footwear parts, other components, or any combination thereof to form a completed article of footwear. In some embodiments, a portion of these components can be moved into contact with the footwear part, other footwear parts, other components, or any combination thereof to form a completed article of footwear. This arrangement can have the benefit of requiring only a single formation step for the footwear part, thereby reducing manufacturing time and complexity.

Embodiments described herein can comprise one or more components formed together in a first position and/or shape and transformed into a second position and/or shape to create a desired footwear structures. In some embodiments, the one or more components can be formed in a first position with at least one planar surface and transformed into a second position where the planar surface is connected to footwear in a non-planar shape. In some embodiments, two or more components can be formed in a first position with at least one planar surface and transformed into a second position where the planar surfaces of the two or more components are connected to each other to form a non-planar shape. By enabling components to be formed with a planar surface that can be transformed to create different shapes, embodiments described herein facilitate the manufacturing of footwear, or footwear components, with a variety of manufacturing techniques, including additive manufacturing techniques, which often build parts on a flat surface.

The one or more components transformed into a second position and/or shape can be connected to each other and/or another footwear part at one or more connection points. In some embodiments, the one or more components can be formed with integral corresponding connectors configured to couple with each other that a connection point. In some embodiments, the one or more connection points can comprise a separate element configured to connect with one or more components at a connection point. Exemplary separate elements comprise, but are not limited to, stitching, lacing, an adhesive, or a mechanical connector such as a threaded connector, a luer-lock connector, or a snap fit connector.

Embodiments described herein can also leverage the transformability of the one or more components to integrate other footwear components not formed together with the one or more components. For example, in some embodiments, the transformability of the one or more components can be used to integrate a textile component. As another example, the transformability of the one or more components can be used to integrate a separate additively manufactured component. In some embodiments, the component (for example, textile component) can be sandwiched between two integrally formed components to attach the component to an article of footwear. In such embodiments, one or more components transformed into a second position can be connected to the component (for example, textile component) and the footwear at one or more connection points. Integrating components such a textile components with a transformable component as described herein can provide a high strength connection between the components.

FIG. 1 shows an article of footwear 100 according to some embodiments. Footwear 100 can generally comprise a toe region 101, a midfoot region 102, and a heel region 103. The portion of footwear 100 that contacts the ground is a sole portion 120. An upper portion 110 connected to sole portion 120 is positioned above sole portion 120 and is generally formed to receive the foot of a user through an opening 104. In some embodiments, sole portion 120 and upper portion 110 can be formed as two separate elements that are joined together. In some embodiments, sole portion 120 and upper portion 110 can be integrally formed as a single piece. Sole portion 120 can define all or a portion of the sole of article of footwear 100 and upper portion 110 can define all or a portion of the upper of article of footwear 100.

In some embodiments, sole portion 120 can comprise a midsole. In some embodiments, sole portion 120 can comprise an outsole. In some embodiments, sole portion 120 can comprise a midsole and an outsole.

In some embodiments, footwear 100 can comprise a toe cage 112 formed in the toe region 101 of footwear 100. Toe cage 112 can be used to reinforce the toe region 101.

In some embodiments, footwear 100 can comprise a heel counter 114 disposed in the heel region 103 of footwear 100. In such embodiments, heel counter 114 can provide a reinforcing function for the heel region 103.

In some embodiments, footwear 100 can comprise laces 115 capable of adjusting the fit of footwear 100 to a user's foot. In such embodiments, laces 115 can pass through lace openings on upper portion 110. In some embodiments, footwear 100 can comprise lace supports 118 to reinforce and support the laces 115 where the laces 115 connect to upper portion 110. In some embodiments, lace supports 118 may reinforce openings formed in upper portion 110 that receive laces 115. In some embodiments, lace supports 118 can comprise openings or apertures for receiving laces 115.

In some embodiments, footwear 100 can comprise a tongue 117 connected to upper portion 110. In some embodiments, tongue 117 can be disposed adjacent to laces 115.

Sole portion 120 is formed with a bottom surface 122 configured to contact the ground when footwear 100 is worn. Bottom surface 122 can comprise suitable tread or traction elements to improve the traction between bottom surface 122 and the ground. In some embodiments, the traction elements can be formed by shaping bottom surface 122 to incorporate non-planar element such as grooves, recesses, ridges, and similar structures. In some embodiments, the traction elements can be provided by an outsole coupled to sole portion 120 at the bottom surface 122.

A top surface 124 of sole portion 120 is opposite bottom surface 122. In some embodiments, top surface 124 can provide an interface between sole portion 120 and upper portion 110. In some embodiments, top surface 124 can comprise a planar surface.

In some embodiments, upper portion 110, sole portion 120, or both can comprise can comprise a three-dimensional mesh comprising a plurality of interconnected unit cells. In some embodiments, upper portion 110, sole portion 120, or both can comprise can comprise a three-dimensional mesh comprising a plurality of interconnected unit cells, with each unit cell comprising a plurality of unit cell struts defining a three-dimensional structure and a plurality of nodes at which one or more unit cell struts are connected. As a non-limiting example shown in FIG. 10, sole portion 120 can comprise a three three-dimensional mesh 180 comprising a plurality of interconnected unit cells 182 comprising plurality of unit cell struts 184 defining a three-dimensional structure and a plurality of nodes 186 at which one or more unit cell struts 184 are connected. In some embodiments, a body 121 of sole portion 120 can comprise a three-dimensional mesh comprising a plurality of interconnected unit cells. In some embodiments, a component 130 can comprise a three-dimensional mesh comprising a plurality of interconnected unit cells.

As used herein, the term three-dimensional mesh refers to a three-dimensional structure comprising a plurality of unit cells 182 arranged in a web-like structure or a lattice structure. The web-like or lattice structure of a three-dimensional mesh comprises interconnected structural members (for example struts 184 or ribbons) defining the plurality of unit cells 182. In embodiments comprising struts 184, the struts 184, and thus the unit cells 182, are connected at nodes 186. For example, the struts 184 are connected at nodes 186 and define unit cells 182 arranged in a lattice configuration. In some embodiments, the plurality of interconnected unit cells 182 can be arranged in a regular or repeating lattice configuration. Exemplary lattice configurations comprise, but are not limited to basic cubic lattices, body-centered cubic lattices, face-centered cubic lattices, and modified lattices based on these lattice types. Exemplary lattice configurations comprise, but are not limited to the lattice structures described in U.S. patent application Ser. Nos. 17/069,623 and 18/313,135, which are hereby incorporated by reference in their entireties.

Unit cells 182 can have various dimensions and geometries. Further, unit cells 182 within a three-dimensional mesh can be the same or may differ. Thus, a three-dimensional mesh can comprise unit cells of different dimensions or geometries. The three-dimensional shape of a unit cell 182 can be defined by a plurality of interconnected struts 184 connected to one another at nodes 186. In such embodiments, each unit cell 182 can have a base geometry defined by the struts 184. As used herein, "base geometry" means the base three-dimensional shape, connection, and arrangement of the struts 184 defining a unit cell 182. The base geometry of a unit cell may be, but is not limited to, a dodecahedron (e.g., rhombic), a tetrahedron, an icosahedron, a cube, a cuboid, a prism, or a parallelepiped.

In some embodiments, the interconnected unit cells 182 can comprise a solid representation of a repeating implicit surface of a lattice structure. In such embodiments, the unit cells can comprise a "base surface geometry" defined by the base three-dimensional shape of a body formed by one or more ribbons (walls) of material that define a solid representation of an implicit surface for a full unit cell. In some embodiments, the implicit surface can be a periodic implicit surface such that the base surface geometry of each unit cell contacts the base surface geometry of at least some adjacent unit cells to create a lattice. One example of a suitable periodic surface is a gyroid, but any type of suitable periodic surface can be used.

Herein, a solid representation of an implicit surface refers to a solid object following the shape of an implicit surface. Whereas an actual implicit surface has no thickness, a solid representation of an implicit surface has a thickness on one or both sides of the actual implicit surface in a three dimensional space. The thickness gives the solid representation volume, meaning the solid representation can be built as a physical object from physical material. The added thickness or thicknesses can be uniform, or at least approximately uniform notwithstanding fillets or local deformities, and thin in comparison to the overall size of the represented implicit surface. In some embodiments, the relative density of a unit cell of the solid representation can be from 5% to 30%, from 5% to 40%, from 10% to 25%, or from 15% to 20%. The term "relative density" as used herein refers to an amount of a unit cell occupied by solid material as a percentage of a total volume of the unit cell.

In some embodiments, the implicit surfaces can be created using a combination of random Fourier series functions, in which linear and or nonlinear coefficient as well as linear and nonlinear variables inside sinuous and cosine terms over the x, y and z space are iterated to generate the functions. The resulting unit cells can have different planes of symmetry, such as, in various examples, zero planes of symmetry, one plane of symmetry, or more than one plane of symmetry. The function can be derived in a way that satisfies the periodicity of the unit cell. Criteria for the selection of an applicable implicit surface within the design space domain can comprise any one or any combination of number of terms in the equation, number of connected components, the edge boundary length, surface area, and volume fraction.

Footwear 100 also comprises one or more components 130 integrally formed with the upper portion 110, the sole portion 120, or both. In some embodiments, one or more components 130 and sole portion 120 can be an integral, single part made in one manufacturing process (for example, an additive manufacturing process). In some embodiments, one or more components 130 and upper portion 110 can be an integral, single part made in one manufacturing process. In some embodiments, one or more components 130, upper portion 110, and sole portion 120 can be an integral, single part made in one manufacturing process.

Components 130 are elements that can be used to form structures on footwear 100 by repositioning or moving components 130 and connecting them at one or more connection points 136. As described herein, each component 130 is connected to the upper portion 110 or the sole portion 120 at a hinged end 133 and comprises a second end 134 that is attached to the upper portion 110, the sole portion 120, or another component 130 at one or more connection points 136. In some embodiments, the hinged end 133 can be opposite the second end 134 of the component 130.

One or more components 130 can define all or a portion of a footwear component on upper portion 110, the sole portion 120, or both. Exemplary components defined by one or more components 130 comprise, but are not limited to, a lace support, a cage (for example, toe cage 112 or a midfoot cage), a flange, a heel counter (for example, heel counter 114), a strap (for example, strap 111), a sleeve, or a tongue (for example, tongue 117). In some embodiments, one or more components 130 can define all or a portion of a footwear component on upper portion 110. In some embodiments, the footwear component defined by component(s) 130 can extend from upper portion 110. In some embodiments, one or more components 130 can define all or a portion of a footwear component on sole portion 120. In some embodiments, the footwear component defined by component(s) 130 can extend from sole portion 120.

In some embodiments, one or more components 130 can act as the partial or complete structural link between different parts of footwear 100. For example, in the embodiments of FIGS. 2-3, components 130 can act as the structural link between upper portion 110 and sole portion 120.

In embodiments comprising a plurality of components 130, each component 130 can be separate from the other component(s) 130. And each of the plurality of components 130 can be connected to the upper portion 110 or the sole portion 120 at a hinged end 133 different from (for example, opposite or adjacent) a second end 134 of the component 130 that is attached to the upper portion 110 or the sole portion 120 at a connection point 136. In some embodiments, the plurality of separate components 130 can be connected to each other on footwear 100 as described herein.

Figure 2:
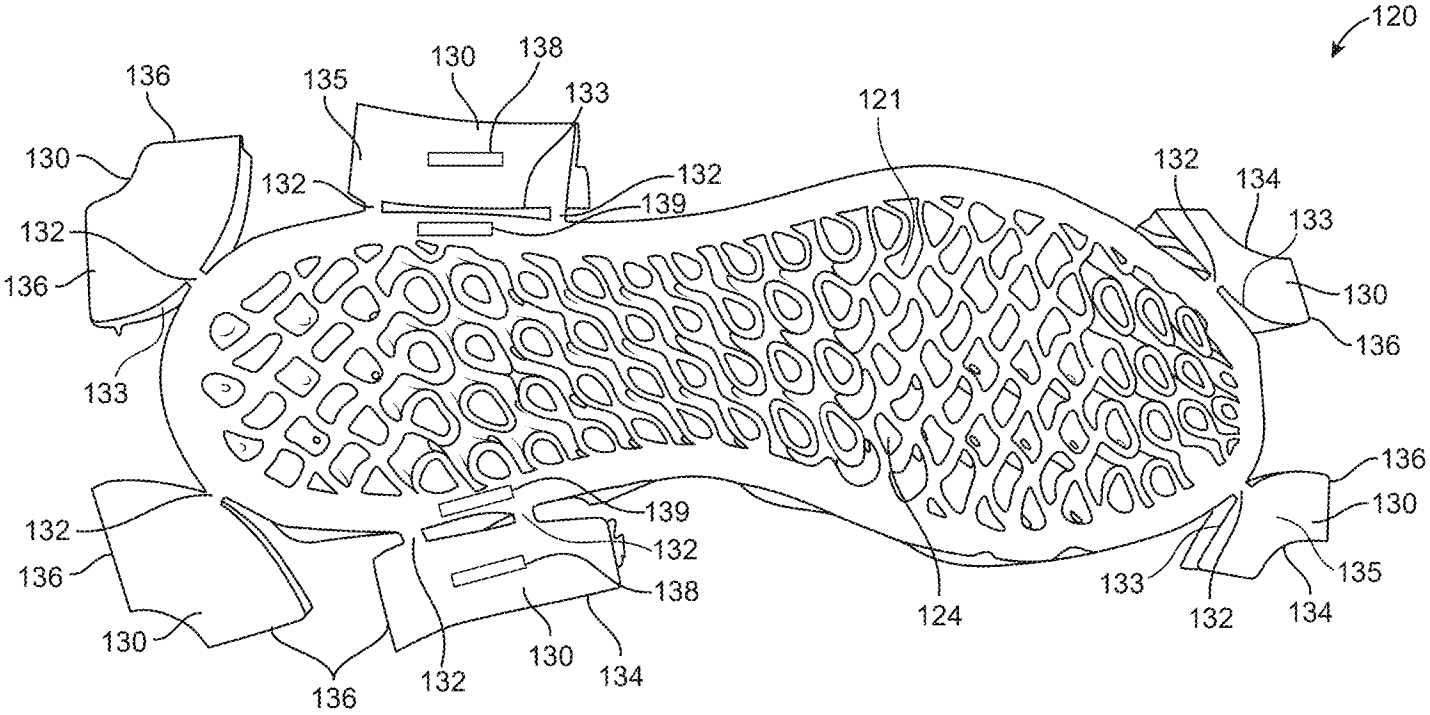
FIG. 2 shows a top view of a sole of an article of footwear according to some embodiments.
Figure 3:
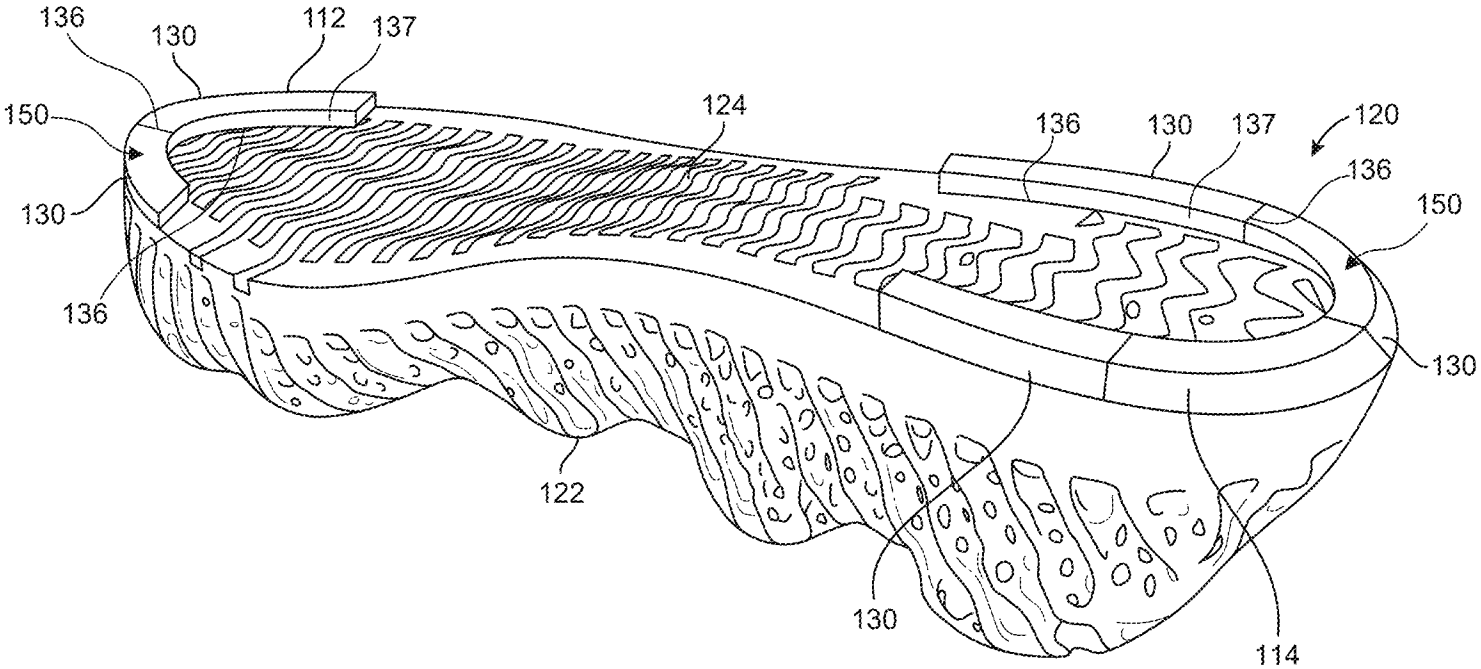
FIG. 3 shows a perspective view of a sole of an article of footwear according to some embodiments.

FIGS. 2 and 3 show a sole portion 120 comprising one or more components 130 according to some embodiments. FIG. 2 shows sole portion 120 with components 130 in a first position. Components 130 are connected to a body 121 of sole portion 120 at a hinged end 133. Hinged end 133 of a component 130 as described herein is an end of the component 130 that is integrally formed with and attached to upper portion 110 and/or the sole portion 120. Before component 130 is connected at a connection point 136, hinged end 133 is configured to allow the component 130 to be moved from a first position where a second end 134 of the component 130 is spatially separated from the connection point 136 to a second position where the second end 134 of the component 130 is attached to the upper portion 110 or the sole portion 120 at the connection point 136. Hinged ends 133 of components 130 can facilitate pivoting of a component 130 from a first position to a second position, inversion of a component 130 from a first position to a second position, or flipping of a component 130 from a first position to a second position. In embodiments comprising a plurality of components 130, the hinged end 133 of each of the plurality of components 130 is configured to allow the component 130 to be moved from a first position where a second end 134 of the component 130 is spatially separated from a respective connection point 136 on the upper portion 110 or the sole portion 120 to a second position where the second end 134 of the component 130 is attached to the upper portion 110 or the sole portion 120 at the respective connection point 136.

In some embodiments, hinged end 133 can comprise one or more connections 132. In such embodiments, connections 132 can be strips of material integrally formed with a component 130. In embodiments comprising connections 132, the connections 132 can act as a hinge that allows components 130 to pivot or fold as they are moved. In some embodiments, connections 132 can be removed after the component 130 is moved to the second position. In some embodiments, this can be accomplished, for example, by incorporating cut lines, grooves, or similar features that facilitate removal of connections 132 in a clean fashion.

A second end 134 of a component 130 is an end that, in the first position, is formed free of any direct connection to other portions of footwear 100 at a connection point 136 (see for example, second ends 134 in FIG. 2). This allows component 130 to be moved such that second end 134 can be connected at a connection point 136 when the component is moved into the second position. In some embodiments, the second end 134 can be in direct contact with a portion of footwear 100 in the second position.

In the embodiment shown in FIGS. 2 and 3, the second ends 134 of the components 130 are in contact with top surface 124 of sole portion 120 at connection points 136. In some embodiments, a surface 135 of components 130 can be in contact with top surface 124 of sole portion 120 when the components 130 are moved to the second position. In some embodiments, the surfaces 135 of the components 130 can be a planar surface. In some embodiments, the surfaces 135 of the components 130 and top surface 124 can be part of the same planar surface on sole portion 120 before the components 130 are moved to the second position.

In some embodiments, the second end 134 can additionally or alternatively be in contact with upper portion 110. In such embodiments, second end 134 can be attached to a surface of upper portion 110.

In some embodiments, one or more components 130 can be integrally formed with the sole portion 120 and the second end 134 of the component(s) 130 is attached to top surface 124 of the sole portion 120 at one or more connection points 136. In such embodiments, the component(s) 130 can additionally be attached to a surface of the upper portion 110. In some embodiments, the one or more components 130 can form all or a portion of a shell 150 on footwear 100 and a portion of the upper portion 110 is received within the shell 150. In such embodiments, an interior surface 137 of component(s) 130 forming shell 150 can be attached to an exterior surface 119 of upper portion 110. In some embodiments, a plurality of components 130 can be integrally formed with the sole portion 120 and form all or a portion of a shell 150 with a portion of the upper portion 110 received within the shell 150. In such embodiments, the interior surface 137 of each component 130 forming shell 150 can be attached to an exterior surface 119 of upper portion 110. As a non-limiting example, FIGS. 1-3 show shells 150 in the form of toe cage 112 and heel counter 114.

In the embodiment shown in FIGS. 2 and 3, sole portion 120 comprises six components 130. Two of the components 130 are positioned in the toe region and in their second position form toe cage 112 extending from sole portion 120. Four of the components 130 are in the heel region and form heel counter 114 extending from sole portion 120 in their second position. While, FIGS. 2 and 3 show components forming toe cage 112 and heel counter 114, other footwear components, such as a lace support, a midfoot cage, a flange, a strap, or a sleeve extending from the sole portion 120 can be defined by one or more components 130 in the same way as toe cage 112 and heel counter 114.

As described herein, components 130 are fixed in their second position at one or more connection points 136. Connection points 136 can be points of connection between components 130 and any portion of footwear 100, including sole portion 120, upper portion 110, or other components 130, or combinations thereof.

In some embodiments, the connection points 136 comprise a mechanical engagement between a first connector 138 on component 130 and a corresponding second connector 139 on upper portion 110, sole portion 120, or another component 130. For example, in some embodiments, a component 130 can comprise a first connector 138 comprising a tab that fits into a corresponding second connector 139 comprising a slot that engages the tab in an interlocking joint (for example, a snap-fit connection). The opposite arrangement is also possible, with the first connector 138 comprising the slot and the second connector 139 comprising the tab. In some embodiments, the slot can be a through aperture. Other mechanical fastening embodiments of connection points 136 comprise an interlocking arrangement comprising first and second connectors 138, 139 comprising protrusions that interlock with each other, similar to a zipper. Some embodiments can alternatively or additionally comprise a separate element, such as stitching or lacing, at a connection point 136. In some embodiments, laces 115 of footwear 100 can connect a component 130 to upper portion 110. For example, in some embodiments, laces 115 can connect a component 130 in the form of a tongue 117 at multiple connection points 136 on upper portion 110.

In some embodiments, the connectors 138, 139 can be integrally formed with the component 130, the upper portion 110, or the sole portion 120. For example, the connectors 138, 139 can be formed using an additive manufacturing process during forming of the component 130, the upper portion 110, or the sole portion 120 using the same additive manufacturing process. Thus, in some embodiments, the connectors 138, 139 can form a seamless structure with a continuous transition between the connectors 138, 139 and the component 130, the upper portion 110, or the sole portion 120, In some embodiments, one or more connection points 136 can alternatively or additionally comprise a mechanical bond. Exemplary mechanical bonds comprise an adhesive bond or a direct bond between materials created by heat bonding. In some embodiments, the mechanical bond can comprise a curd resin. In some embodiments, the cured resin can be located in a joint between a first connector 138 and a corresponding second connector 139. In some embodiments, the cured resin can be formed from the same material as component 130 connected at the connection point 136.

As a non-limiting example, FIGS. 2 and 3 show components 130 integrally formed with the sole portion 120. In their second position, the second end 134 of the components 130 is attached to top surface 124 of the sole portion 120 at connection points 136. In some embodiments, the second end 134 of the components 130 can be bonded to top surface 124 (for example, via adhesive bonding or heat bonding). In some embodiments, components 130 can be formed with a first connector 138 that is connected to a second connector 139 formed on the top surface 124 of the sole portion 120. In such embodiments, the second end 134 of the components 130 can additionally or alternatively attached to top surface 124 via an engagement between first connector 138 and second connector 139.

Figure 4:
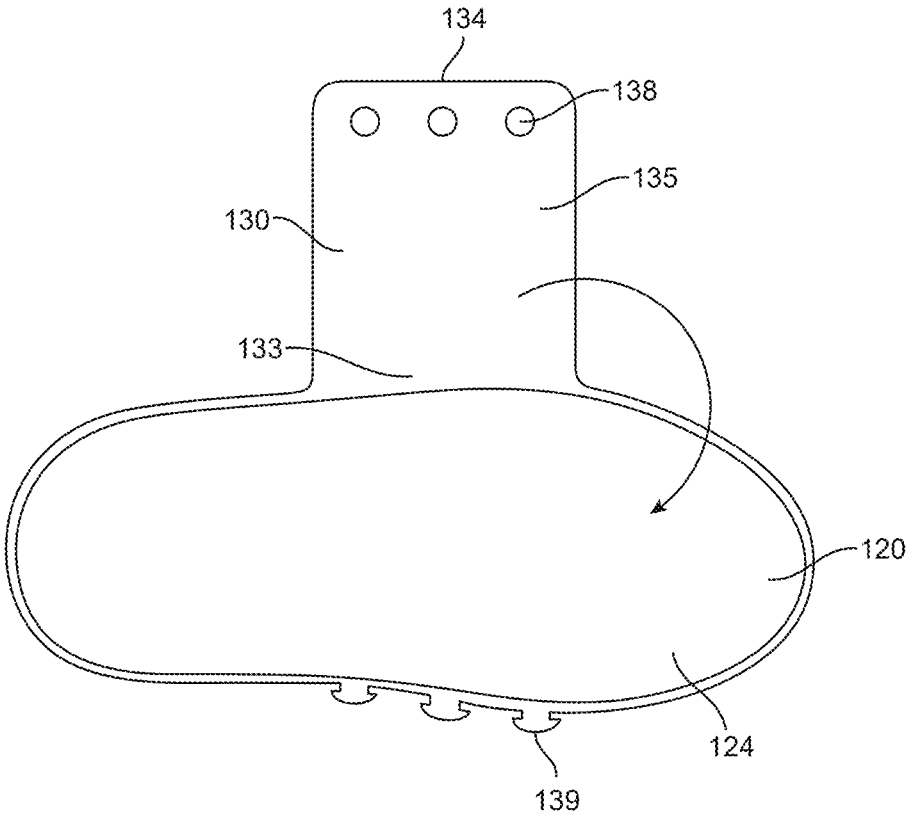
FIG. 4 show a top view of an article of footwear according to some embodiments.
Figure 5:
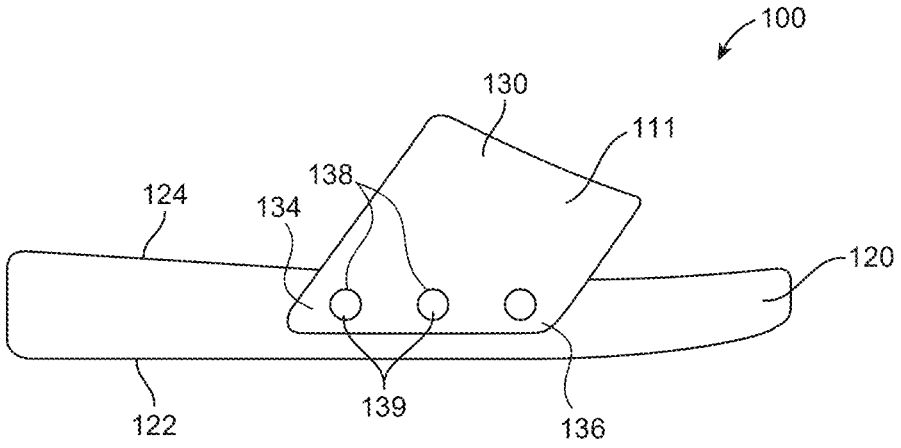
FIG. 5 shows a side view of an article of footwear according to some embodiments.

FIGS. 4 and 5 show another exemplary embodiment of footwear 100 comprising a component 130 with a hinged end 133 connected to sole portion 120 and a second end 134 connected to the sole portion 120 via connectors 138, 139 at a connection point 136. In some embodiments, a surface 135 of the component 130 can be a planar surface. In some embodiments, the surface 135 and top surface 124 can be part of the same planar surface on sole portion 120 before the component 130 is moved to a second position.

In the embodiment shown in FIGS. 4 and 5, the component 130 forms a slide strap 111 over the sole portion 120. In this embodiment, the component 130 is formed with sole portion 120 and with a hinged end 133 positioned on one side of footwear 100. In a first position, the component 130 extends from sole portion 120 with a second end 134 not connected at a connection point 136. In a second position, the component 130 is folded over about hinged end 133 and secured at connection point 136 via connectors 138 on second end 134 and connectors 139 on sole portion 120. While FIGS. 4 and 5 illustrate the component 130 in the form of a slide strap 111, other footwear components, for example a lace support, a midfoot cage, a toe cage, or a sleeve can be formed in the same manner as strap 111.

In some embodiments comprising multiple components 130, at least two components 130 of the plurality of components 130 can be configured to engage each other. In some embodiments, each of the plurality of components 130 can be formed with a connector 138 that is connected to a corresponding connector 139 on another one of the components 130. In such embodiments, the multiple components 130 can be connected to each other at one or more connection points 136.

Figure 6:
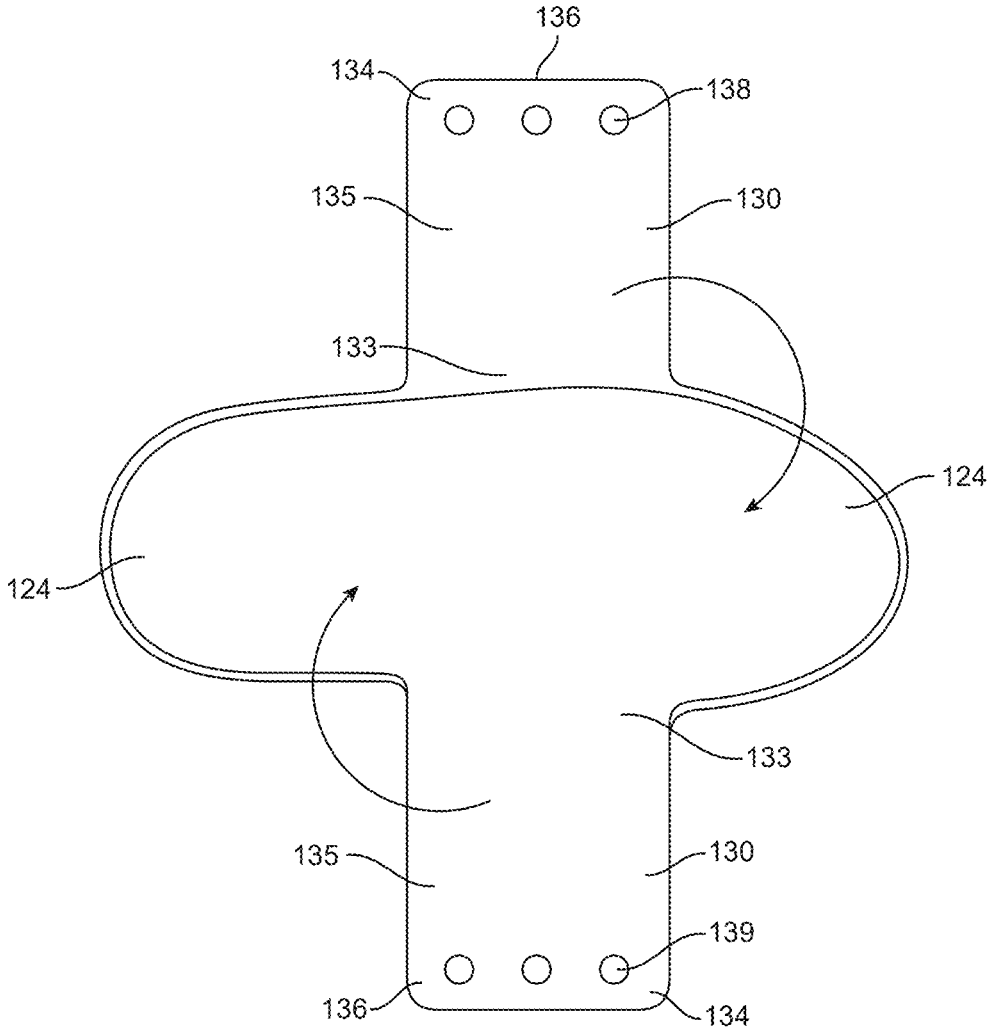
FIG. 6 show a top view of an article of footwear according to some embodiments.
Figure 7:
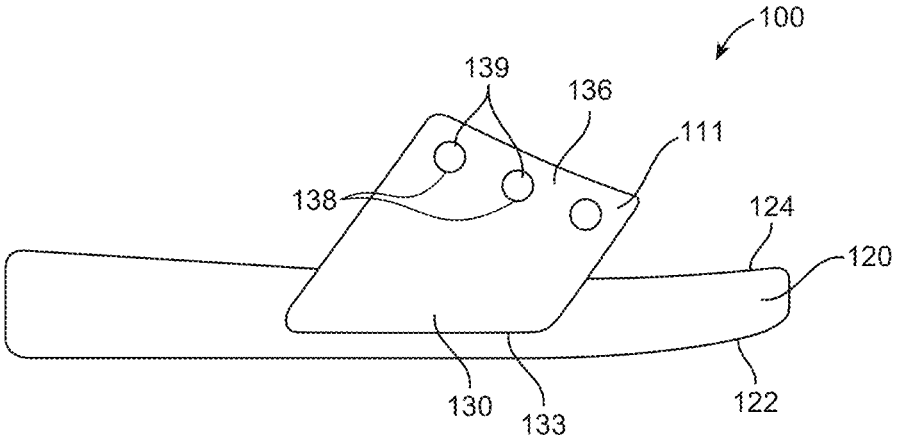
FIG. 7 shows a side view of an article of footwear according to some embodiments.

As a non-limiting example, FIGS. 6 and 7 show an embodiment of footwear 100 comprising two components 130 with hinged ends 133 connected to sole portion 120 and second ends 134 connected to each other via connectors 138, 139 at a connection point 136 to form an upper portion 110 in the form of a slide strap 111. In some embodiments, surfaces 135 of the components 130 can be a planar surface. In some embodiments, the surfaces 135 and top surface 124 can be part of the same planar surface on sole portion 120 before the components 130 are moved to a second position.

In this embodiment, the two components 130 are formed with sole portion 120 and comprise respective hinged ends 133 positioned on opposing sides of footwear 100. In a first position, the two components 130 extend from sole portion 120 with second ends 134 not connected at a connection point 136. In a second position, the components 130 are folded inwards to be joined together at a connection point 136 via connectors 138, 139 to form the slide strap over the sole portion 120. While FIGS. 6 and 7 illustrate the connected components 130 in the form of a slide strap 111, other footwear components, for example a lace support, a midfoot cage, a toe cage, or a sleeve can be formed in the same manner as strap 111.

In some embodiments, one or more components 130 can comprise a connector 138 connected to a corresponding connector 139 on sole portion 120 or upper portion 110 at a first connection point 136 and a connector 138 connected to a corresponding connector 139 on another component 130 at a second connection point 136. In such embodiments, moving the component 130 to a second position as described herein can comprise connecting the corresponding connectors 138, 139 at both the first and second connection points 136. Components 130 can comprise any number of connectors 138 that connect to corresponding connectors 139 on sole portion 120, upper portion 110, or another component 130.

Figure 8:
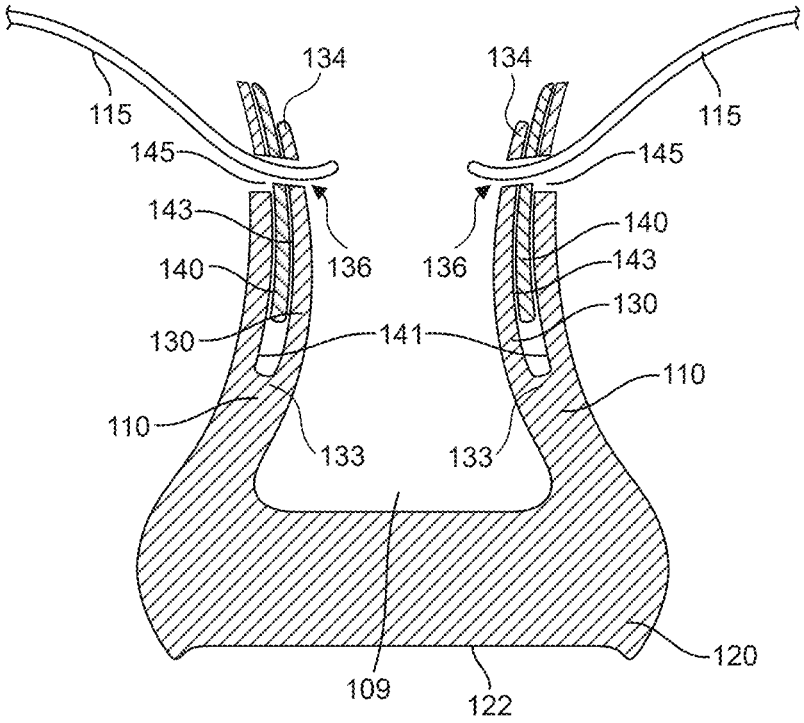
FIG. 8 shows a cross section of an article of footwear according to some embodiments.

In some embodiments, one or more components 130 can be used to integrate other elements into footwear 100. In some embodiments, a separate additively manufactured component can be disposed between a component 130 and at least one of the sole portion 120 or the upper portion 110 of footwear 100. In some embodiments, a textile component 140 can be disposed between a component 130 and at least one of the sole portion 120 or the upper portion 110 of footwear 100. For example, as shown in FIG. 8, component (s) 130 can be used to sandwich a textile component 140 between a component 130 and upper portion 110. In such embodiments, the component(s) 130 can be formed as a flap-type structure inside upper portion 110. In some embodiments, the component(s) 130 can define all or a portion of a strap, a lace support, a cage, a flange, a heel counter, or a sleeve on article of footwear 100. In some embodiments, the component(s) 130 can define all or a portion of a strap, a lace support, a cage, a flange, a heel counter, or a sleeve attached to upper portion 110 of article of footwear 100 at a hinged end 133. In some embodiments, the component(s) 130 can define all or a portion of a strap, a lace support, a cage, a flange, a heel counter, or a sleeve attached to sole portion 120 of article of footwear 100 at a hinged end 133. In some embodiments, the component(s) 130 can define all or a portion of a strap, a lace support, a cage, a flange, a heel counter, or a sleeve attached to upper portion 110 of article of footwear 100 at a hinged end 133 within an open space 109 inside upper portion 110. In some embodiments, the component(s) 130 can define all or a portion of a strap, a lace support, a cage, a flange, a heel counter, or a sleeve attached to sole portion 120 of article of footwear 100 at a hinged end 133 within an open space 109 inside upper portion 110.

Textile component 140 can be disposed between the interior facing surface 141 of upper portion 110 and an exterior facing surface 143 of component 130. Component 130 can be connected to upper portion 110 and textile component 140 using any of the techniques discussed herein to sandwich textile component 140 against upper portion 110. For example, in FIG. 8, laces 115 can connect upper portion 110, textile component 140, and component(s) 130 at connection points 136.

In some embodiments, the textile component 140 can be part of a tongue (for example, the tongue 117). In some embodiments, the textile component 140 can be part of a sleeve or strap coupled to upper portion 110.

The textile component 140 can comprise one or more textile materials. In some embodiments, the textile material can be a non-woven, woven, braided, or knitted fabric material. Exemplary fabric materials comprise, but are not limited to, thermoplastic polyurethane (TPU), polyester, polyamide, polyethylene (PE), PE foam, polyurethane (PU) foam, nylon, ultra-high molecular weight polyethylene (for example, DYNEEMA® (a type of ultra-high molecular weight polyethylene)), carbon fiber, KEVLAR® (a type of para-aramid), synthetic spider silk, cotton, wool, natural or artificial silk, polyethersulfone (PES), ELASTAN® (a polyether-polyurea copolymer), or a blend of two or more of these materials. In some embodiments, the textile material can be a polymeric sheet or film, for example, a TPU sheet or film. In some embodiments, the textile material can be a mesh material.

In some embodiments, a tongue, for example tongue 117, can comprise a textile component 140 as described herein. In some embodiments, an article of footwear can comprise a lace support comprising a textile component 140 as described herein. In some embodiments, an article of footwear can comprise a strap comprising a textile component 140 as described herein.

In some embodiments, textile component 140 can comprise a first textile portion located on one of a lateral side or a medial side of the footwear 100. In some embodiments, at least part of the first textile portion can be located between the upper portion 110 and a first component 130. In such embodiments, at least part of the first textile portion can be sandwiched between an exterior facing surface 143 of the first component 130 and interior facing surface 141 of upper portion 110. In some embodiments, the first textile portion can be coupled to exterior facing surface 143 of the first component 130 and to interior facing surface 141 of upper portion 110 using a curable material. For example, the curable material can comprise a curable resin or other type of curable adhesive capable of coupling the first textile portion to the first component 130 and the upper portion 110. In some embodiments, the curable material can be applied to the components before or after assembly and then cured to secure the components together.

In some embodiments, the first textile portion can comprise one or more openings 145 at connection points 136. In some embodiments, the one or more openings 145 can receive lace 115. In some embodiments, the one or more openings 145 can receive one or both of a connector 138 or a connector 139 on first component 130 and upper portion 110 to secure the first textile portion between the upper portion 110 and the first component 130. In such embodiments, the opening(s) 145 can create an interlocking engagement between the first textile portion, upper portion 110, and the first component 130. In some embodiments, the first textile portion can be secured between the upper portion 110 and the first component 130 using both a curable material and one or more openings 145. In some embodiments, the first textile portion can be secured between the upper portion 110 and the first component 130 using only one of the curable material or opening(s) 145.

In some embodiments, footwear 100 can comprise a second component 130 and textile component 140 can comprise a second textile portion located on the other of the lateral side or the medial side of the upper portion 110. In some embodiments, the second textile portion can be located between the upper portion 110 and the second component 130 and can be coupled to the upper portion 110 and the second component 130 in the same ways as those described with respect to the first component 130. For example, the second textile portion can comprise an opening 145 received by laces 115, or by one or both of a connector 138 or a connector 139. In such embodiments, the opening(s) 145 can create an interlocking engagement between the second textile portion, upper portion 110, and the second component 130. The second textile portion can additionally or alternatively be coupled to the second component 130 and the upper portion 110 using a curable material.

Separate components other than a textile component 140 can be connected to footwear 100 in the same manner as textile components 140. Exemplary other components comprise an additively manufactured component, a plastic insert, or a foam insert.

Figure 9:
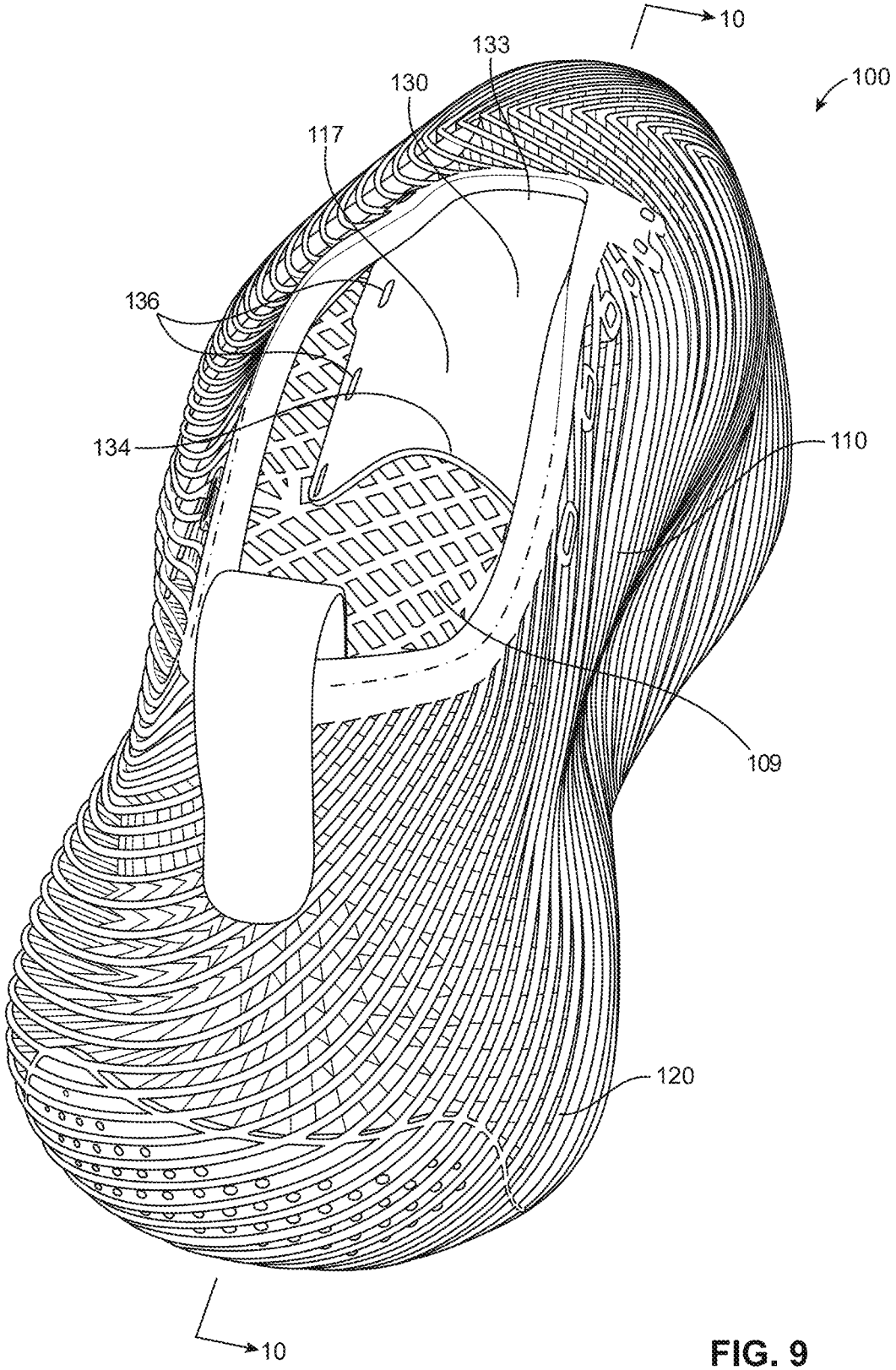
FIG. 9 shows a perspective view of an article of footwear according to some embodiments.
Figure 10:
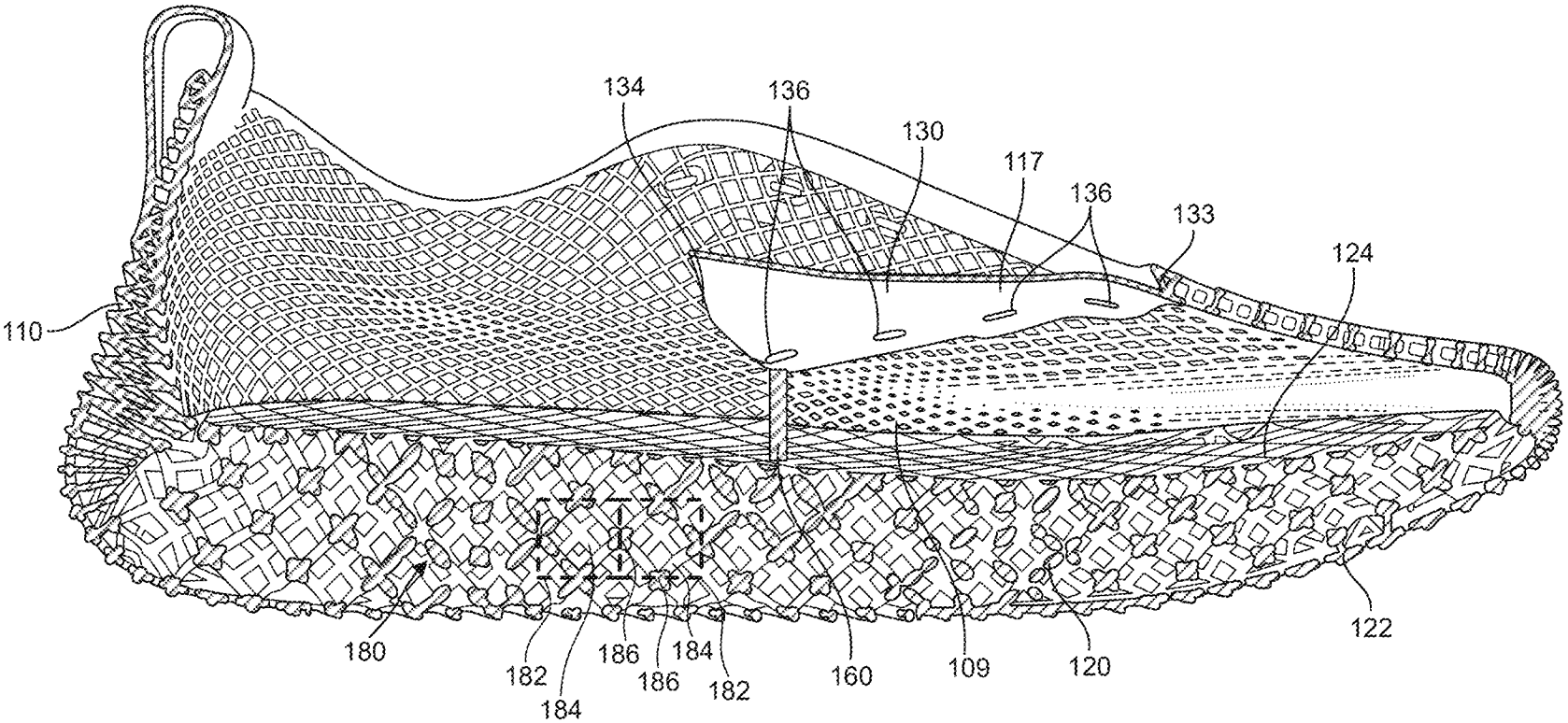
FIG. 10 shows a cross-section of the article of footwear of FIG. 9 according to some embodiments.

FIGS. 9 and 10 show an article of footwear 100 according to some embodiments. In some embodiments, footwear 100 can be made as a single, integral component with upper portion 110 and sole portion 120 made as a single part. In some embodiments, the open space 109 inside upper portion 110 of footwear 100 can comprise one or more components 130. For example, the open space 109 can comprise one or more components 130 defining all or a portion of a strap, a lace support, a cage, a flange, a heel counter, or a sleeve in the open space 109 inside upper portion 110.

In some embodiments, tongue 117 can be formed as component 130 being connected at a hinged end 133 at the base of tongue 117 (the end closet to toe region 101). In such embodiments, tongue 117 can comprise a second end 134 connected to upper portion 110 connection points 136 in the form of openings that receive lace 115. In such embodiments, lace 115 can be laced through the openings in tongue 117 and corresponding lace openings on upper portion 110.

In some embodiments, as shown in FIG. 10, during manufacturing, tongue 117 can be supported by one or more supports 160 that hold tongue 117 in a first position within open space 109 by supporting second end 134. Support(s) 160 can be removed after formation of tongue 117 and before moving tongue 117 into a second position where tongue 117 is connected at connection points 136. Any other component 130 described herein can similarly be supported by one or more supports 160 that hold the component 130 in a first position within open space 109 by supporting a second end 134 of the component 130.

As discussed herein, upper portion 110, sole portion 120, or both can be made as a single, integral part. Components 130 connected to the upper portion 110, sole portion 120, or both, at hinged ends 133 are made as a single, integral part of the upper portion 110, sole portion 120, or both. Upper portion 110, sole portion 120, and components 130 can be made of flexible, lightweight materials. Examples of these materials comprise, but at not limited to, a foam, a rubber, ethyl vinyl acetate (EVA), a thermoplastic elastomer, a polyurethane, a thermoplastic polyurethane (TPU), an elastomeric polyurethane, an expanded thermoplastic polyurethane (eTPU), an expanded elastomeric polyurethane, a polyether block amide (PEBA), an expanded polyether block amide (ePEBA), a thermoplastic rubber (TPR), and a polyolefin, for example polyethylene (PE), polystyrene (PS), or polypropylene (PP), polyamides (nylon), or a combination of any of these materials, or a foam comprising one or more of these materials. Additional materials for use in forming upper portion 110, sole portion 120, and components 130 comprise carbon and carbon allotropes, such as graphene, carbon nanotubes, and carbon fibers, fiber reinforced polymers, biological materials such as Mycelium, and metals, such as aluminum, steel, or titanium, among others and combinations thereof.

Examples of manufacturing techniques that can be used to form upper portion 110, sole portion 120, and components 130 in the form of a single, integral part comprise molding, casting, and additive manufacturing (three-dimensional (3-D) printing).

Exemplary additive manufacturing techniques include for example, selective laser sintering, selective laser melting, selective heat sintering, stereo lithography, fused deposition modeling, or 3-D printing in general. Various additive manufacturing techniques related to articles of footwear are described for example in US 2009/0126225, WO 2010/126708, US 2014/0300676, US 2014/0300675, US 2014/0299009, US 2014/0026773, US 2014/0029030, WO 2014/008331, WO 2014/015037, US 2014/0020191, EP 2564719, EP 2424398, and US 2012/0117825. In some embodiments, the additive manufacturing process can include a continuous liquid interface production process. For example, the additive manufacturing process can include a continuous liquid interface production process as described in U.S. Pat. No. 9,453,142, issued on Sep. 27, 2016, which is hereby incorporated in its entirety by reference thereto.

In some embodiments, 3-D printing an article of footwear, or component thereof, can comprise 3-D printing the article or component in an intermediate green state, shaping the article or component in the green state, and curing the green state in its final shape. In some embodiments, 3-D printing an article of footwear, or component thereof, can comprise 3-D printing the article or component in an intermediate green state, expanding the intermediate green state, shaping the article or component in the green state, and curing the green state in its final shape.

Techniques for producing an intermediate green state object from resins by additive manufacturing are known. Suitable techniques include bottom-up and top-down additive manufacturing, generally known as stereolithography. Such methods are known and described in, for example, U.S. Pat. No. 5,236,637 to Hull, U.S. Pat. Nos. 5,391,072 and 5,529,473 to Lawton, U.S. Pat. No. 7,438,846 to John, U.S. Pat. No. 7,892,474 to Shkolnik, U.S. Pat. No. 8,110,135 to El-Siblani, U.S. Patent Application Publication No. 2013/0292862 to Joyce, and US Patent Application Publication No. 2013/0295212 to Chen et al. The disclosures of these patents and applications are incorporated by reference herein in their entirety.

In some embodiments, the additive manufacturing step can be carried out by one of the family of methods sometimes referred to as continuous liquid interface production (CLIP). CLIP is known and described in, for example, U.S. Pat. Nos. 9,211,678; 9,205,601; 9,216,546; and others; in J. Tumbleston et al., Continuous liquid interface production of 3D Objects, *Science* 347, 1349-1352 (2015); and in R. Janusziewcz et al., Layerless fabrication with continuous liquid interface production, *Proc. Natl. Acad. Sci. USA* 113, 11703-11708 (Oct. 18, 2016). Other examples of methods and apparatus for carrying out particular embodiments of CLIP include, but are not limited to: Batchelder et al., US Patent Application Pub. No. US 2017/0129169 (May 11, 2017); Sun and Lichkus, US Patent Application Pub. No. US 2016/0288376 (Oct. 6, 2016); Willis et al., US Patent Application Pub. No. US 2015/0360419 (Dec. 17, 2015); Lin et al., US Patent Application Pub. No. US 2015/0331402

(Nov. 19, 2015); D. Castanon, US Patent Application Pub. No. US 2017/0129167 (May 11, 2017). B. Feller, US Pat App. Pub. No. US 2018/0243976 (published Aug. 30, 2018); M. Panzer and J. Tumbleston, US Pat App Pub. No. US 2018/0126630 (published May 10, 2018); K. Willis and B. Adzima, US Pat App Pub. No. US 2018/0290374 (Oct. 11, 2018) L. Robeson et al., PCT Patent Pub. No. WO 2015/164234 (see also U.S. Pat. Nos. 10,259,171 and 10,434,706); and C. Mirkin et al., PCT Patent Pub. No. WO 2017/210298 (see also US Pat. App. US 2019/0160733). The disclosures of these patents and applications are incorporated by reference herein in their entirety.

While stereolithography techniques such as CLIP can be preferred, it will be appreciated that other additive manufacturing techniques, such as jet printing (see, e.g., U.S. Pat. No. 6,259,962 to Gothait and US Patent App. Serial No. US 2020/0156308 to Ramos et al.) can also be used.

In embodiments comprising an upper portion 110 and/or a sole portion 120 comprising one or more components 130 made using a three-dimensional printing process, the upper portion 110 and/or the sole portion 120 comprising one or more components 130 can be built on a flat build surface. As a result, a surface of the upper portion 110 and a surface of one or more components 130 can comprise a planar surface built on the flat build surface. Similarly, a surface of the sole portion 120 and a surface of one or more components 130 can comprise a planar surface built on the flat build surface.

As used herein, the term "planar surface" means the surface that has an exterior surface profile having at least 30% of the surface's area lying on a single, flat plane. In some embodiments, an exterior surface profile can have at least 50% of the surface's area lying on a single, flat plane. A planar surface having an exterior surface profile with at least 30% of the surface's area lying on a single, flat plane can facilitate three-dimensional printing of the upper portion 110 and/or the sole portion 120 comprising one or more components 130 by ensuring sufficient contact between the printed part and the build surface during printing.

In some embodiments, as described herein, a top surface 124 of sole portion 120 can comprise a planar surface built on a build plate. In such embodiments, this allows bottom surface 122 of the sole portion 120 to be formed with a non-planar surface. A bottom surface 122 comprising a non-planar surface can facilitate formation of unique traction features on bottom surface 122 not achievable if bottom surface 122 was built on the build plate.

In some embodiments, bottom surface 122 comprising a non-planar surface can comprise integrally formed tread or traction elements to improve the traction between sole portion 120 and the ground. In some embodiments, the traction elements can be formed by printing bottom surface 122 to incorporate non-planar elements such as bumps, grooves, recesses, ridges, and similar structures. In some embodiments, an outsole can be coupled to the traction elements formed on the bottom surface 122.

In some embodiments, upper portion 110 and/or a sole portion 120 comprising one or more components 130 can be formed in a partially-cured state, often referred to as a green state. In some embodiments, components 130 can be moved and/or connected as described herein while the components 130 are in the green state. In such embodiments, after moving and/or connecting components 130, components 130 can be cured into a final state. In some embodiments, the components 130 can be moved and connected after being cured into the final state. Curing can be accomplished by a heat treatment, application of a curing chemical, application of ultraviolet or other types of light, or combinations of these techniques. In some embodiments, a jig or fixture can be used to hold one or more footwear components 130 in a second position during the curing process. In such embodiments, the jig can be applied after the component(s) 130 are moved to the second position and is removed after the curing process is completed.

In some embodiments, a method of manufacturing an article of footwear as described herein can comprise integrally forming a footwear part (for example, upper portion 110, sole portion 120, or both) and one or more components 130 connected to the footwear part at a hinged end 133 of the component 130 as a single piece in a first position. In some embodiments, forming the footwear part (for example upper portion 110 or sole portion 120) and one or more components 130 connected to the footwear part at a hinged end 133 of the component 130 can comprise 3-D printing the part and the one or more components 130 a build surface of a build plate. In some embodiments, a green 3-D printed part and component 130 can be printed on the build surface. In some embodiments, integrally forming a footwear part (for example upper portion 110 or sole portion 120) and one or more components 130 can comprise printing one or more supports 160 as described herein. In such embodiments, supports 160 can be removed before moving the component(s) 130 to a second position.

After integrally forming a footwear part and one or more components 130, the method can comprise moving the second end(s) 134 of the component(s) 130 relative to the footwear part and into a second position. In some embodiments, moving the second end(s) 134 can be performed while the footwear part and the one or more components 130 are in a green state. In such embodiments, the method can comprise curing the component(s) 130 in the second position. In some embodiments, the footwear part and the one or more components 130 can be fully cured before the second end(s) 134 of the component(s) 130 are moved relative to the footwear part and into the second position.

In some embodiments, moving the second end(s) 134 of the component(s) 130 relative to the footwear part can put the second end(s) 134 into contact with the footwear part. For example, in some embodiments, the footwear part can comprise sole portion 120 and the movement of the component(s) 130 places the second end(s) 134 of the component(s) 130 in contact with top surface 124 of sole portion 120. As another example, in some embodiments, the footwear part can comprise upper portion 110 and movement of the component(s) 130 places the second end(s) 134 of the component(s) 130 in contact with upper portion 110.

In some embodiments, moving the second end(s) 134 of the component(s) 130 relative to the footwear part can comprise applying a jig to the component(s) when in the second position to shape the component(s) 130 in the second position. In some embodiments, the jig can be applied while the footwear part and the component(s) 130 are in a green state. In some embodiments, the jig can be applied with the footwear part and the component(s) 130 in a fully cured state.

In some embodiments, a separate component (for example, a textile component 140) can be positioned between the footwear part and one or more component(s) 130 before moving the component(s) 130 into the second position. In such embodiments, the method can comprise connecting the separate component (for example, textile component 140) to the footwear part and the one or more component(s) 130 as described herein.

After moving the second end(s) 134 of the component(s) 130 into a second position, the second end(s) 134 can be connected to the footwear part at one or more connection points 136 as described herein. In some embodiments, connecting the second end(s) 134 can be performed while the footwear part and the one or more components 130 are in a green state. In some embodiments, the footwear part and the one or more components 130 can be fully cured before the second end(s) 134 of the component(s) 130 are connected at connection point(s) 136. In some embodiments, connecting the second end(s) 134 can comprise connecting one or more first connectors 138 integrally formed with the component(s) 130 to corresponding second connector(s) 139 integrally formed with the footwear part at the connection point(s) 136.

In some embodiments, fully curing the footwear part and the one or more components 130 can comprise heating the footwear part and the one or more components 130 to a temperature ranging from greater than or equal to 100° C. to less than or equal to 130° C. In some embodiments, the footwear part and the one or more components 130 can be heated to a temperature ranging from greater than or equal to 110° C. to less than or equal to 120° C. to fully cure the footwear part and the one or more components 130.

In some embodiments, connecting second end(s) 134 at one or more connection points 136 can comprise disposing the curable resin between the footwear part and the one or more components 130, and curing the resin. In some embodiments, the curable resin can be disposed in a joint between a first connector 138 and a corresponding second connector 139.

In some embodiments, connecting second end(s) 134 at one or more connection points 136 can comprise disposing the curable resin between the footwear part and the one or more components 130 when the part and component(s) 130 are in a green state. In such embodiments, the method can comprise at least partially curing the curable resin when the part and component(s) 130 are in a green state. In some embodiments, the curable resin comprises a material that is the same as the material forming at least one of the footwear part and the one or more component(s) 130. In some embodiments, the curable resin can be at least partially cured with the application of heat. In some embodiments, the resin can be at least partially cured at a temperature ranging from greater than or equal to 110° C. to less than or equal to 120° C.

In some embodiments, the method can comprise connecting sole portion 120 and one or more components 130 to an upper portion 110. In some embodiments, the upper portion 110 can be connected to the sole portion 120 and the component(s) 130 after the component(s) 130 are moved to a second position and connected to the sole portion 120 at one or more connection points 136. For example, one or more component(s) 130 can be moved and connected in a second position to form a shell 150 that receives and is connected to upper portion 110.

In some embodiments, a green footwear part with one or more components 130 can be expanded before or after connecting the component(s) 130 at one or more connection points 136. In some embodiments, the green footwear part with one or more components 130 can be heated to expand the footwear part and component(s) 130. In some embodiments, the green footwear part and component(s) 130 can be heated to a temperature ranging from greater than or equal to 100° C. to less than or equal to 130° C. to expand footwear part and component(s) 130. In some embodiments, the green footwear part and component(s) 130 can be heated to a temperature ranging from greater than or equal to 110° C. to less than or equal to 120° C. to expand the footwear part and component(s) 130. Expanding the footwear part and component(s) 130 comprises increasing the volume of the footwear part and component(s) 130. In some embodiments, the volume can be increased by at least 10%, by at least 20%, or by at least 50%.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. An article of footwear, comprising:

an upper portion;

a sole portion connected to the upper portion, the sole portion comprising:

a three-dimensional mesh comprising a plurality of interconnected unit cells, each interconnected unit cell comprising a plurality of unit cell struts defining a three-dimensional structure and a plurality of nodes at which one or more unit cell struts are connected; and a component integrally formed with the upper portion, the sole portion, or both and connected to one of the upper portion or the sole portion at a hinged end opposite a second end of the component, wherein the second end is at least partially formed with a second end surface, the second end surface attached to a surface of the one of the upper portion or the sole portion at a connection point, and wherein the second end is also fixed to the other one of the upper portion or the sole portion.

2. The article of footwear of claim 1, wherein the hinged end is configured to allow the component to be moved from a first position where the second end of the component is spatially separated from the connection point on the upper portion or the sole portion to a second position where the second end of the component is attached to the upper portion or the sole portion at the connection point.

3. The article of footwear of claim 1, wherein the component is integrally formed with the sole portion, and wherein the surface that the second end of the component is attached to is a top surface of the sole portion.

4. The article of footwear of claim 3, wherein the component is formed with a first connector that is connected to a second connector formed on a top surface of the sole portion, and wherein the component is attached to a surface of the upper portion.

5. The article of footwear of claim 1, comprising a plurality of the components, each component being separate from the other components, and each component being connected to the upper portion or the sole portion at a hinged end opposite a second end of the component that is attached to the upper portion or the sole portion at a connection point.

6. The article of footwear of claim 5, wherein the hinged end of each of the plurality of components is configured to allow the component to be moved from a first position where the second end of the component is spatially separated from the respective connection point on the upper portion or the sole portion to a second position where the second end of the component is attached to the upper portion or the sole portion at the respective connection point.

7. The article of footwear of claim 5, wherein each of the plurality of components is formed with a first connector that is connected to a corresponding second connector formed on a top surface of the sole portion, and wherein each of the plurality of components is attached to a surface of the upper portion.

8. The article of footwear of claim 5, wherein the plurality of components form all or a portion of a lace support, a cage, a flange, a heel counter, a strap, or a sleeve extending from the sole portion.

9. The article of footwear of claim 5, wherein the plurality of components are integrally formed with the sole portion, wherein the plurality of components form all or a portion of a shell, and a portion of the upper portion is received within the shell.

10. The article of footwear of claim 5, wherein each of the components is connected to another component of the plurality of components at a second connection point.

11. The article of footwear of claim 1, wherein the component forms all or a portion of a lace support, a cage, a flange, a heel counter, a strap, a sleeve, or a tongue.

12. The article of footwear of claim 1, further comprising a textile component disposed between the component and at least one of the sole portion or the upper portion.

13. An article of footwear, comprising:

an upper portion;

a sole portion connected to the upper portion; and a plurality of components integrally formed with the sole portion, and connected to the sole portion at a hinged end opposite a second end of the component that is attached to the sole portion at a connection point, wherein each component of the plurality of components is connected to another component of the plurality of components at a second connection point, wherein each component of the plurality of components is formed with a first connector that is connected to a second connector that is formed on a top surface of the sole portion, and wherein each component of the plurality of components is attached to a surface of the upper portion.

14. The article of footwear of claim 13, wherein the hinged end is configured to allow each component of the plurality of components to be moved from a first position where the second end of the component is spatially separated from the connection point on the sole portion to a second position where the second end of the component is attached to the sole portion at the connection point.

* * * * *